United States Patent [19]

Williamson

[11] 4,239,414

[45] Dec. 16, 1980

[54] BRACKET FOR ATTACHING RAILS TO STEEL FENCE POSTS

[76] Inventor: Charles H. Williamson, 823 E. 5th St., Galesburg, Ill. 61401

[21] Appl. No.: 95,772

[22] Filed: Nov. 19, 1979

[51] Int. Cl.[3] ..... F16B 9/00

[52] U.S. Cl. ..... 403/387; 256/65; 248/243

[58] Field of Search ..... 403/395, 398, 399, 387; 256/68, 65; 248/125, 243, 245, 246, 248

[56] References Cited

U.S. PATENT DOCUMENTS

| | | | |
|---|---|---|---|
| 141,498 | 8/1873 | Edmonston | 248/246 |
| 1,419,193 | 6/1922 | Allen | 403/399 |
| 1,694,887 | 12/1928 | Meyer | 248/246 |
| 3,617,076 | 11/1971 | Attwood | 403/395 |
| 3,756,568 | 9/1973 | Mocny | 256/65 X |

*Primary Examiner*—Andrew V. Kundrat
*Attorney, Agent, or Firm*—Glenn H. Antrim

[57] ABSTRACT

A bracket comprises a thin piece of rigid material having two parallel bends to form a bottom or rest on which the lower edge of a board or rail is to be placed, a side generally at a right angle to the rest to extend vertically up the side of the board, and an opposite side slanting upwardly and having an opening through which a steel post is to extend. Positioning a board between the vertical side and lugs of a steel post retains the slanting side in position to cause an edge of the rest to bear against flanges of the post and to be supported on a lug. Before a board is placed in the bracket, the side that is normally vertical is tipped until its upper edge contacts the flanges to place the opening toward a horizontal direction for allowing space for the rest to clear the lugs as the bracket is moved along the post.

4 Claims, 7 Drawing Figures

BRACKET FOR ATTACHING RAILS TO STEEL FENCE POSTS

BACKGROUND OF THE INVENTION

This invention relates to brackets for attaching horizontal members to vertical members and particularly to brackets for attaching wood rails to steel fence posts of the type having a T-shaped cross section.

Solid steel fence posts having a T-shaped cross section have commonly been used for many years for supporting wire fence. Brackets are not generally available for fastening wood rails, boards placed end-to-end, to steel posts. Suitable clamps ought to be easily attached and to provide neat appearance. Although clamps have been devised for attaching horizontal members of scaffolds to vertical rectangular members or round members, these clamps are not adaptable for application to T-shaped posts.

SUMMARY OF THE INVENTION

The present bracket is a piece of thin, rigid material having two intermediate parallel bends. The portion between the bends is a bottom rest on which a rail is to be supported. One side turned up at one of the bends is to be positioned vertically along a side of the rail; an opposite side of the bracket slants upwardly from the other bend and contains an opening through which the fence post is to extend. The bracket is preferably stamped from a sheet of steel and provided with a reinforcing rib.

The dimensions of the opening, the respective angles between the bottom rest and the sides, and the height of that side to be positioned along the side of a rail are proportioned to permit the bracket to be moved over spaced lugs of steel posts while a rail is not in place, but when a rail is in place to hold the bracket tightly about the post and to support it firmly on a lug. While a rail is not positioned within the bracket, the upper edge of the side that is normally adjacent a side of a rail may be moved toward the post for rotating the opposite side that has an opening through which the post extends. The opposite side that is normally bent upwardly is then rotated to be in a plane more nearly horizontal to position the altitude of the opening for the post more directly across the post. The horizontal distance between opposite edges of the opening are then sufficient to permit the bracket to be moved longitudinally along the post over the lugs for positioning the bracket as desired.

DESCRIPTION OF THE PREFERRED EMBODIMENT

Figure 1:
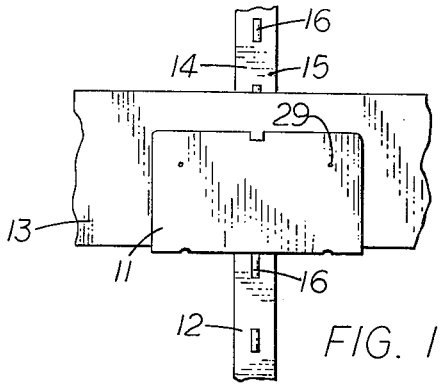
FIG. 1 is a front view of the bracket of this invention shown with a fragment of a rail and of a steel post.
Figure 2:
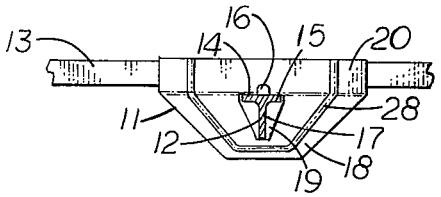

A bracket 11 of this invention is shown in FIG. 1 positioned on a steel post 12 for holding a board 13, the board representing a fence rail. The fence post 12 is a usual type having a T-shaped cross section as shown in FIG. 2, the T-shaped being provided by a bar 17 and flanges 14 and 15 extending in opposite directions from one edge of the bar. Projections or lugs 16 spaced along the same edge of the bar 17 extend outwardly beyond the outer surfaces on the flanges 14 and 15.

Figure 3:
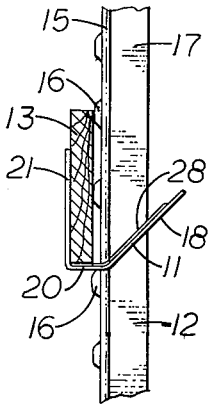
FIGS. 2, 3, and 4 are bottom, side, and rear perspective views respectively of the bracket as shown in FIG. 1.
Figure 4:
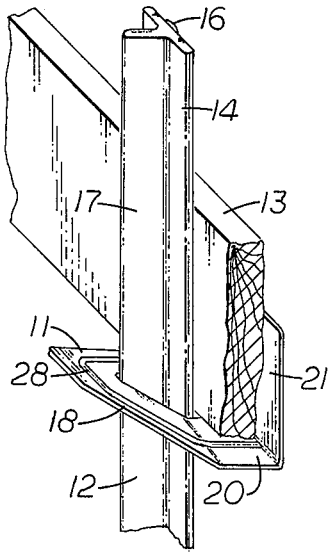

With reference to FIGS. 3 and 4, the bracket 11 is supported on the steel post 12 by a slanting side 18, the side having an opening 19 through which the post 12 extends. The lower portion of the slanting side 18 bends into a narrow horizontal portion or rest 20 along the bottom edge of the rail 13, and an opposite side of the rest bends into a side 21 extending vertically along a side of the board 13. As shown in FIGS. 2 and 3, a lower edge of the rest 20 at the opening 19 bears downwardly on the upper portion of one of the lugs 16 that is just below the level at which the rail 13 is to be positioned.

Figure 5:
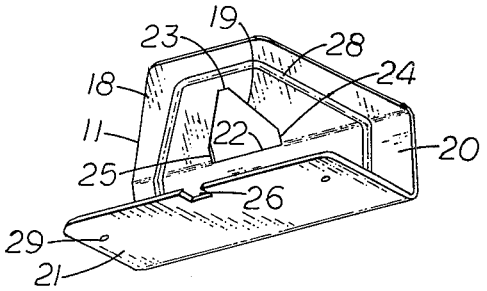
FIG. 5 is a perspective view of the bracket.
Figure 6:
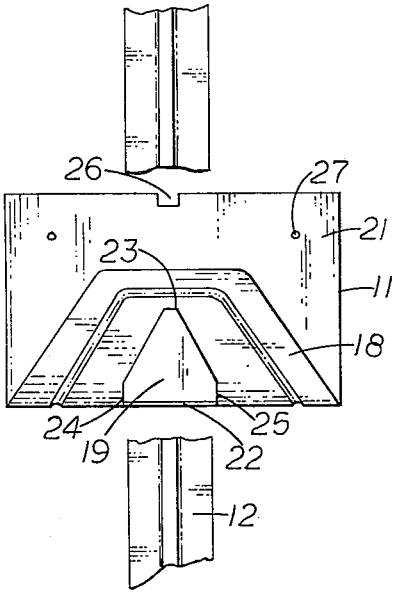
FIG. 6 is a rear view of the bracket.

As shown most clearly in FIG. 3, the side 18 is preferably inclined at an angle of 45 degrees with respect to the side 21, and since the bottom rest 20 is preferably horizontal, the side 18 makes an obtuse angle of 135 degrees with respect to the rest 20. The bracket is preferably stamped from 0.07-inch (1.8-mm) steel, bent into the shape shown in FIGS. 5 and 6, and galvanized. The slanting side 18 is preferably an isosceles trapezoid with a generally triangular opening 19 having a base 22 within the middle portion of the bend between the side 18 and the rest 20. The opening 19 differs from an isosceles triangle at three points: an apex has been cut off to provide a short side 23 somewhat longer than the width of that edge of the bar 17 which is opposite the edge to which the flanges 14 and 15 are connected; and both of the equal sides of the opening 19 turn inwardly perpendicularly to the base 22 to form the perpendicular portions 24 and 25 to be positioned across the outer edges of the flanges 14 and 15, respectively. The perpendicular portions 24 and 25 extend straight from the base 22 for a distance at least equal to the depth of the lugs 16 to permit the edge of the rest 20 at the base 22 of the opening 19 to be moved outwardly over the lugs. The length of the altitude between the base 22 and the short side 23 is somewhat longer than the depth of the bar 17 plus the depth of each of the lugs 16, and the distance between the lateral perpendicular portions 24 and 25 is slightly greater than the distance between the outer edges of the flanges 14 and 15. The width of the rest 20 between the parallel bends along the adjacent sides 18 and 21 is equal to the depth of each of the lugs 16 plus the thickness of the board or rail 13 that is to be supported by the bracket 11 on the post 12.

Figure 7:
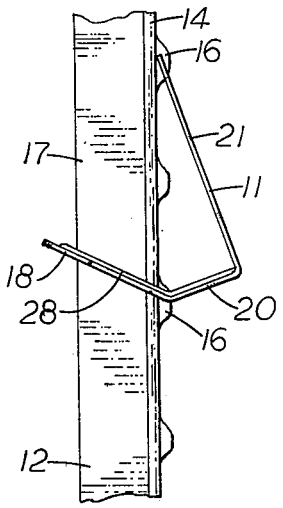
FIG. 7 is a side view of the bracket shown positioned for sliding on the post.

The height of the side 21 to be positioned along one side of the rail 13 is determined with respect to the angles of parallel bends to permit the bracket 11 to be rotated as required for moving it along the post 12. In FIG. 7, the bracket 11 is shown rotated at an angle with respect to the post 12 such that the lower edge of the side 18 at the center of the base 22 of the opening 19 clears the outer surface of each of the lugs 16. When the upper edge of the side 21 is moved adjacent the flanges 14 and 15, the side 18, that is normally at an angle of 45 degrees with respect to the horizontal rest 20, is rotated toward the horizontal direction such that the altitude of the opening 19 is more directly across the bar 17 of the post 12. The bracket 11 can then be moved over any of the lugs 16 to a desired position for inserting the rail 13. As the side 21 is rotated to a position to allow placing the rail 13 within the bracket 11, the side 18 is rotated to the 45-degree position such that a horizontal projection of the altitude of the opening 19 is equal to the depth of the bar 17 for positioning the edge of the rest 20 firmly against the outer surfaces of the flanges 14 and 15 against a lug 16.

The dimensions of the bracket 11 as shown have been chosen to provide the greatest amount of strength for the amount of material that is used and to provide easy installation of the bracket 11 on the post 12. The width of the rest 20 is equal to the depth of the lugs 16 plus the width of the board 13. For example, for a board that has a finished width of ¾ inch (19 mm), the width of the rest 20 for typical lugs is 1 inch (25.4 mm). The angle between the rest 20 and the side 21 that fit along the bottom and a side respectively of the board 13 is usually 90 degrees, and the angle between the rest 20 and the opposite side 18 is preferably 135 degrees to provide an angle of 45 degrees between the two sides.

Since the side 18 has moderate dimensions, a reinforcing rib 28 between its opening and its edge provides required strength. The height of the portion of the side 21 opposite the flanges 14 and 15 of a post 12 must be limited such that the bracket 11 can be rotated to permit movement of the bracket over the lugs 16. Although the bracket could be bifurcated such that it would extend along the sides of the post, extra material would be required and the bracket would be clumsy to use. Preferably, the upper edge of the side 21 is straight except for a central notch 26 that is deep enough and wide enough to permit the lugs 16 to pass through the notch as the adjacent portions of the upper edge slide along the flanges 14 and 15. The upper edge of the side 21 therefore functions as a guide sliding along the flanges 14 and 15 to position the side 18 at the desired angle for sliding the bracket 11 along the post 12.

When the angles of the bends of the bracket 11 are those given above and the thickness of the rail 13 is ¾ inch (19 mm), the altitude of the opening 19 between the base 22 and the short side 23 is 1.91 inch (48.5 mm) for a steel post having a bar 17 that is 1⅜ inches (34.9 mm) between its edges, and the height of the side 21 is 3.5 inches (88.9 mm). A desirable width of the side 21 in a horizontal direction along the rail 13 is 5 inches (127 mm). The angle of the direction of side 18 with respect to the direction of the side 21 cannot be much greater than 45 degrees and still have the altitude of the opening 19 sufficient to clear the lugs 16. Also the height of the portion of the side 21 opposite the post 12 would need to be undesirably short. If the angle between the two sides is substantially smaller than 45 degrees, the altitude of the opening must be longer, and the tendency is to weaken the bracket and to require more material.

The side 18 has intermediate three of its sides and the opening 19 the continuous reinforcing rib 28, and the rib extends through the adjacent bend and across the bottom rest 20. The raised portion of the rib is toward the inside of the bracket and provides ridges across the bottom rest 20 to support the lower edge of the rail 13, thereby providing a space for rain water to flow either over the ends of the rest 20 or out the opening 19 to help preserve the rail. Two holes 29 spaced from each of the upper corners of the side 21 are provided for nails or for screws for retaining the rail 13 securely to the bracket 11.

I claim:

1. A bracket for attaching a rail to a steel post having a T-shaped crosssection, the post being the type having a bar, a pair of flanges and a plurality of spaced lugs, said flanges extending in opposite directions from a first edge of said bar, said lugs projecting from said first edge outwardly from a line intermediate said pair of flanges, said bracket comprising:

a formed piece of thin rigid material having first and second parallel bends to define between said bends a generally horizontal bottom rest for said rail and adjacent each of said first and second bends first and second turned-up sides respectively, said first and second sides being turned up at respective predetermined first and second angles to said rest, said rest having a width approximately equal to the width of said rail plus the depth of said lugs, said first side having an opening for positioning said first side around said post, said opening having a base line within said first bend and a short side opposite said base line, said short side being positioned with respect to said base like an apex of an isosceles triangle, said base line being just long enough to extend across said flanges and said short side being only long enough to extend across a second edge of said bar, an altitude between said base and said short side being somewhat greater than the depth of said bar plus the depth of said lugs, said opening having adjacent each of the ends of said base along respective sides thereof respective portions substantially perpendicular to said base, said perpendicular portions extending along said respective sides of said opening a distance at least equal to the depth of said lugs to provide clearance for said base to be moved over said lugs while said post extends through said openings, said first angle included between said first side and said rest being an obtuse angle, said second angle being determined such that said second side while said bracket is supporting said post bears against a side of said rail while an opposite side of said rail bears against at least one of said lugs, the sum of said first and second angles being determined such that said short side of said opening while said rail is being supported bears against said second edge of said bar to position said base against said flanges and an upper edge of one of said lugs immediately below said rest, and the height of a portion of said second side opposite said post being determined with respect to said first and second angles such that an upper edge of said second side while said rail is removed can be moved toward said flanges sufficiently to permit said first side to be rotated to the extent required to move said bracket along said post over said lugs.

2. A bracket as claimed in claim 1 in which said first angle is approximately 135 degrees and said angle is approximately 90 degrees.

3. A bracket as claimed in claim 1 having a plurality of spaced projections across the surface of said rest for supporting said rail.

4. A bracket as claimed in claim 3 having a reinforcing rib in said first side about said opening and terminating across said rest to form said spaced projections.

* * * * *